US009882308B1

(12) United States Patent
Yi et al.

(10) Patent No.: US 9,882,308 B1
(45) Date of Patent: Jan. 30, 2018

(54) RECEPTACLE CONNECTOR FOR A WEARABLE ARTICLE

(71) Applicants: TYCO ELECTRONICS CORPORATION, Berwyn, PA (US); Tyco Electronics Canada ULC, Markham (CA)

(72) Inventors: Chong Hun Yi, Mechanicsburg, PA (US); Simon Boutin, Toronto (CA); Keith Edwin Miller, Manheim, PA (US); Dustin Carson Belack, Hummelstown, PA (US)

(73) Assignees: TE CONNECTIVITY CORPORATION, Berwyn, PA (US); TYCO ELECTRONICS CANADA ULC., Markham (CA)

( * ) Notice: Subject to any disclaimer, the term of this patent is extended or adjusted under 35 U.S.C. 154(b) by 0 days.

(21) Appl. No.: 15/346,182

(22) Filed: Nov. 8, 2016

(51) Int. Cl.

| | |
|---|---|
| ***H01R 13/24*** | (2006.01) |
| ***H01R 12/79*** | (2011.01) |
| ***H01R 12/62*** | (2011.01) |
| ***H01R 13/629*** | (2006.01) |
| ***H01R 13/641*** | (2006.01) |
| ***H01R 11/20*** | (2006.01) |

(52) U.S. Cl.
CPC ..... *H01R 13/62938* (2013.01); *H01R 11/20* (2013.01); *H01R 13/641* (2013.01)

(58) Field of Classification Search
CPC .... H01R 13/24; H01R 4/2433; H01R 4/2429; H01R 12/79; H01R 12/62; H01R 9/0757; A41D 1/002
USPC ..... 439/37, 76.1, 493, 404, 405
See application file for complete search history.

(56) References Cited

U.S. PATENT DOCUMENTS

| | | | | |
|---|---|---|---|---|
| 4,392,701 | A * | 7/1983 | Weidler | H01R 31/02 439/405 |
| 5,421,741 | A * | 6/1995 | David | H01R 12/675 439/405 |
| 5,620,331 | A * | 4/1997 | Los | H01R 12/58 439/404 |
| 6,062,899 | A * | 5/2000 | Presley | H01R 13/641 439/489 |
| 6,109,950 | A * | 8/2000 | Trammel | H01R 12/675 439/404 |
| 6,231,377 | B1 * | 5/2001 | Fernsebner | H01R 13/2421 439/395 |
| 6,296,514 | B1 * | 10/2001 | Medina | H01R 13/6658 439/404 |
| 7,618,260 | B2 * | 11/2009 | Daniel | A44C 5/0007 24/311 |
| 7,854,624 | B1 * | 12/2010 | Pepe | H01R 13/518 439/489 |
| 8,758,241 | B2 * | 6/2014 | Charles, Jr. | A61B 5/0002 235/1 R |

(Continued)

*Primary Examiner* — Gary Paumen

(57) ABSTRACT

A receptacle connector is provided for a wearable article. The receptacle connector includes a housing having a receptacle configured to receive a complementary plug connector therein. The housing is configured to be mounted to the wearable article. A printed circuit board is held by the housing. The printed circuit board includes mating contacts for mating with the plug connector. The printed circuit board includes mounting contacts that are configured to terminate conductors of a flat cable of the wearable article or an e-textile of the wearable article.

20 Claims, 14 Drawing Sheets

(56) References Cited

U.S. PATENT DOCUMENTS

| | | | | |
|---|---|---|---|---|
| 2005/0277307 | A1* | 12/2005 | Zollo | H01R 4/64 439/37 |
| 2007/0026695 | A1* | 2/2007 | Lee | H01R 12/592 439/37 |
| 2016/0093988 | A1* | 3/2016 | Yue | A41D 1/005 361/86 |

* cited by examiner

RECEPTACLE CONNECTOR FOR A WEARABLE ARTICLE

BACKGROUND OF THE INVENTION

The subject matter described and/or illustrated herein relates generally to receptacle connectors for wearable articles.

Connectors are sometimes integrated into clothing, apparel, and/or other wearable articles worn by an individual in a variety of different applications, such as, but not limited to, first responders (e.g. fire and police), maintenance technicians, soldiers, and/or the like. Known connectors that are integrated into wearable articles are not without problems. For example, in some environments, such as when the connectors are being used outside or in other harsh environments, contaminants such as dirt, mud, grease, sand, and/or other debris, and/or fluids such as water and/or oil may get trapped within a receptacle connector. Contaminants may enter the receptacle while the receptacle connector is disconnected from the complementary plug connector, or while the connectors are mated if the mating interface is not sealed. Such contaminants may contaminate the mating interface of the connector and/or otherwise impede mating of the plug and receptacle connectors, which for example may interrupt the electrical connection and/or damage the connector(s). Removal of such contaminants may be difficult and/or time consuming. For example, it may be difficult to clean the mating interface of a connector in the field. Moreover, attempting to clean the mating interface of a connector may damage of the conductors of the connector. For example, using tools, fingers, thumbs, cloths, and/or the like to remove the contaminants may damage the conductors. Some contaminants may be permanently trapped beneath the conductors of a connector.

BRIEF DESCRIPTION OF THE INVENTION

In an embodiment, a receptacle connector is provided for a wearable article. The receptacle connector includes a housing having a receptacle configured to receive a complementary plug connector therein. The housing is configured to be mounted to the wearable article. A printed circuit board is held by the housing. The printed circuit board includes mating contacts for mating with the plug connector. The printed circuit board includes mounting contacts that are configured to terminate conductors of a flat cable of the wearable article or an e-textile of the wearable article.

In an embodiment, a receptacle connector is provided for a wearable article. The receptacle connector includes a housing having a receptacle configured to receive a complementary plug connector therein. The housing is configured to be mounted to the wearable article. Contacts are held by the housing. The contacts are arranged in a mating interface along which the receptacle connector mates with the plug connector. The contacts include mating surfaces at which the contacts mate in physical contact with corresponding mating contacts of the plug connector. The receptacle of the housing is defined by a channel that extends a length along the housing from a first end to a second end. At least the first end of the channel is open. The channel has a bottom and a top that extend along the length of the channel. The mating interface of the receptacle connector extends along the bottom of the channel. The top of the channel is open over the mating interface such that the mating surfaces of the contacts are exposed through the top. The top of the channel is open through the first end of the channel such that a continuous pathway is defined from the mating interface through the first end.

In an embodiment, a wearable article includes a sheet of material configured to be worn by an individual, and a receptacle connector mounted to the sheet of material. The receptacle connector includes a housing having a receptacle configured to receive a complementary plug connector therein, and a printed circuit board held by the housing. The printed circuit board includes mating contacts for mating with the plug connector. The printed circuit board includes mounting contacts that terminate conductors of a flat cable of the wearable article or an e-textile of the wearable article.

DETAILED DESCRIPTION OF THE INVENTION

Figure 1:
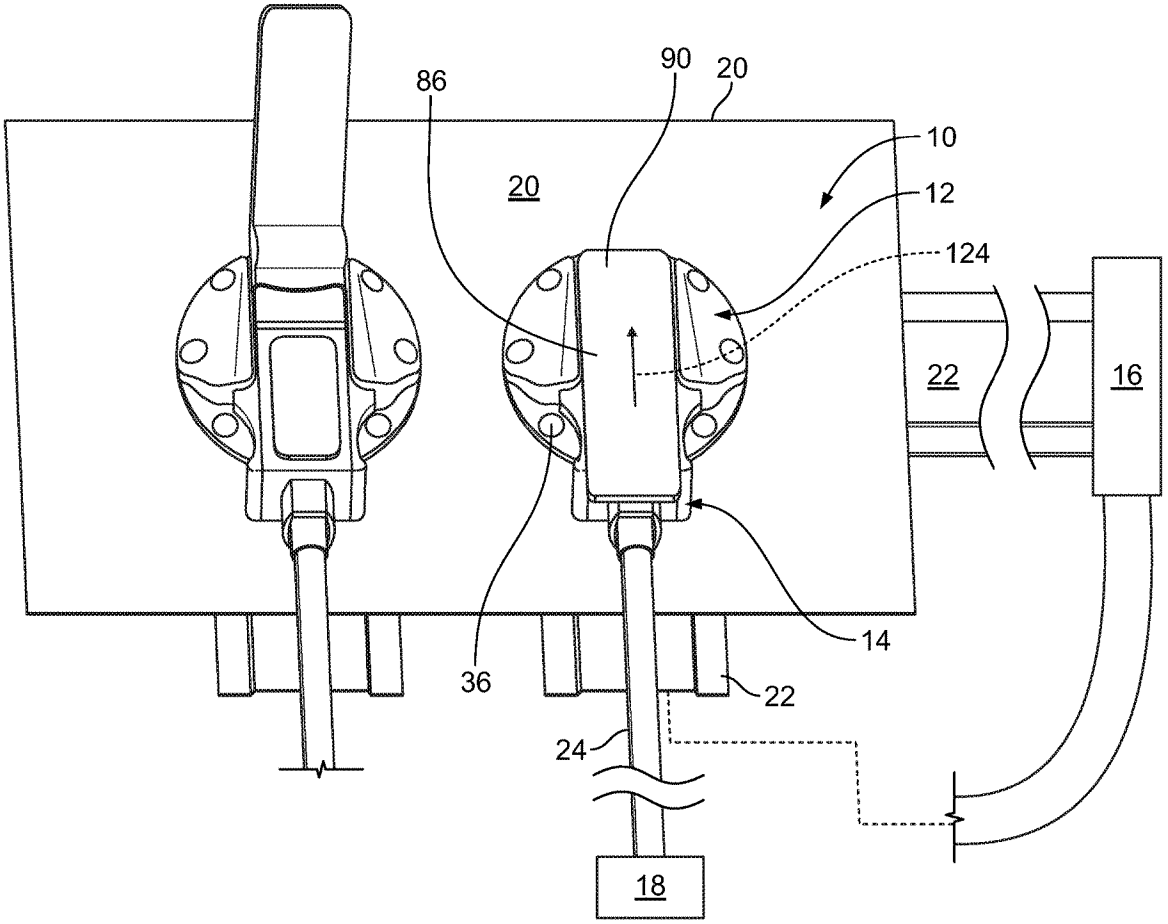
FIG. 1 is a perspective view of an embodiment of a connector system.

FIG. 1 is a perspective view of an exemplary embodiment of a connector system 10. The connector system 10 includes a receptacle connector 12 and a plug connector 14 that mate together to form an electrical and/or fiber optic connection therebetween. The connector system 10 is provided along an electrical and/or fiber optic path between two devices 16 and 18 for providing a separable electrical and/or fiber optic connection between the devices. The connector system 10 is optionally mounted to any type of wearable article 20, such as, but not limited to, a vest, a shirt, a jacket, pants, trousers, a boot, a shoe, a helmet, a hat, a cap, a coat, armor, and/or the like. The connector system 10 may be configured to operate at any standard, protocol, and/or the like, such as, but not limited to, USB 1.0, USB 2.0, USB 3.0, CAN-BUS, GIGA-BIT ETHERNET, and/or the like. The connector system 10 may be scalable to a variety of different sizes.

The devices 16 and 18 each may be any type of electronic, fiber optic, and/or other type of device. In one exemplary embodiment, the device 16 is a battery pack and the device 18 is an LED array that is powered by the battery pack 16. Other types of devices may be interconnected by the connector system 10 in other embodiments.

In the illustrated embodiment, the receptacle connector 12 terminates a plurality of flat cables 22 of the wearable article 20. The flat cables 22 connect the receptacle connector 12 to the device 16. Although a plurality of flat cables 22 are shown for connecting the receptacle connector 12 to a single device 16, the receptacle connector 12 may terminate any number of flat cables 22 of the wearable article 20 for connecting the receptacle connector 12 to any number of devices. In other embodiments, the receptacle connector 12 terminates an e-textile (not shown) that includes fabrics that enable computing, digital components, electrical pathways, fiber optic pathways, and/or electronic and/or fiber optic devices to be embedded therein. Specifically, the e-textile provides the wearable article 20 with wearable technology that allows for the incorporation of built-in technological elements into the fabric of the wearable article 20. The wearable article 20 may constitute intelligent clothing or smart clothing.

The plug connector 14 is also shown in the illustrated embodiment as being electrically connected to the corresponding device 18 via a corresponding cable 24. But, in other embodiments, the plug connector 14 may be mounted directly to the device 18.

Figure 2:
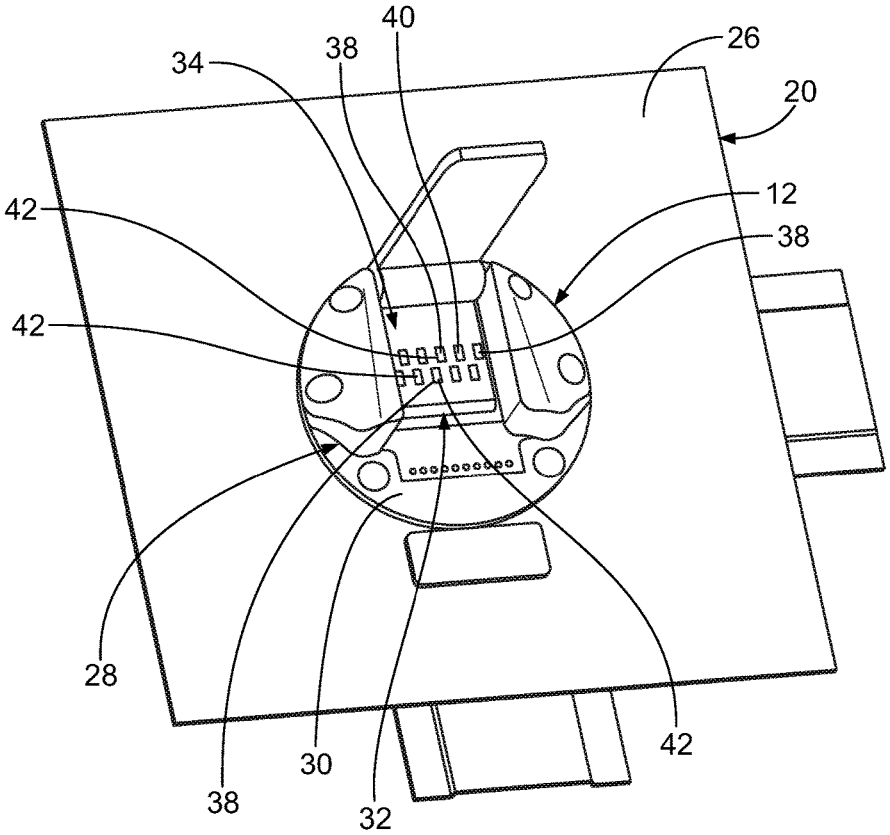
FIG. 2 is a front perspective view of an embodiment of a receptacle connector of the connector system shown in FIG. 1.

FIG. 2 is a front perspective view of an embodiment of the receptacle connector 12. The receptacle connector 12 is shown in FIG. 2 as mounted to a sheet of material 26 of the wearable article 20, as is also shown in FIG. 1. The receptacle connector 12 includes a housing 28 that is shown mounted to the sheet 26 of the wearable article 20. The housing 28 includes a front mounting plate 30. The front mounting plate 30 includes a channel 32 that defines a receptacle 34 of the receptacle connector 12. The channel 32 enables the receptacle 34 to be cleaned (e.g., wiped). The channel 32 will be described in more detail below.

The receptacle 34 of the receptacle connector 12 is configured to receive a plug 36 (shown in FIGS. 1 and 7-10) of the plug connector 14 (shown in FIGS. 1 and 7-10) therein for mating the connectors 12 and 14 together. In other words, the plug 36 of the plug connector 14 is inserted (i.e., plugged) into the receptacle 34 of the receptacle connector 12 to mate the plug connector 14 with the receptacle connector 12. The receptacle connector 12 includes contacts 38 that are arranged in a mating interface 40 within the receptacle 34. The receptacle connector 12 is configured to mate with the plug connector 14 along the mating interface 40 to electrically and/or fiber-optically connect the connectors 12 and 14 together. Specifically, the mating interface 40 is configured such that mating surfaces 42 of the contacts 38 mate in physical contact with corresponding mating contacts 96 (shown in FIGS. 7-10) of the plug connector 14 when the connectors 12 and 14 are mated together. Each of the contacts 38 may be a signal contact, a ground contact, or a power contact. In the illustrated embodiment, the contacts 38 are surface pads of the printed circuit board 44 (described below). The contacts 38 may be referred to herein as "mating contacts".

Figure 3:
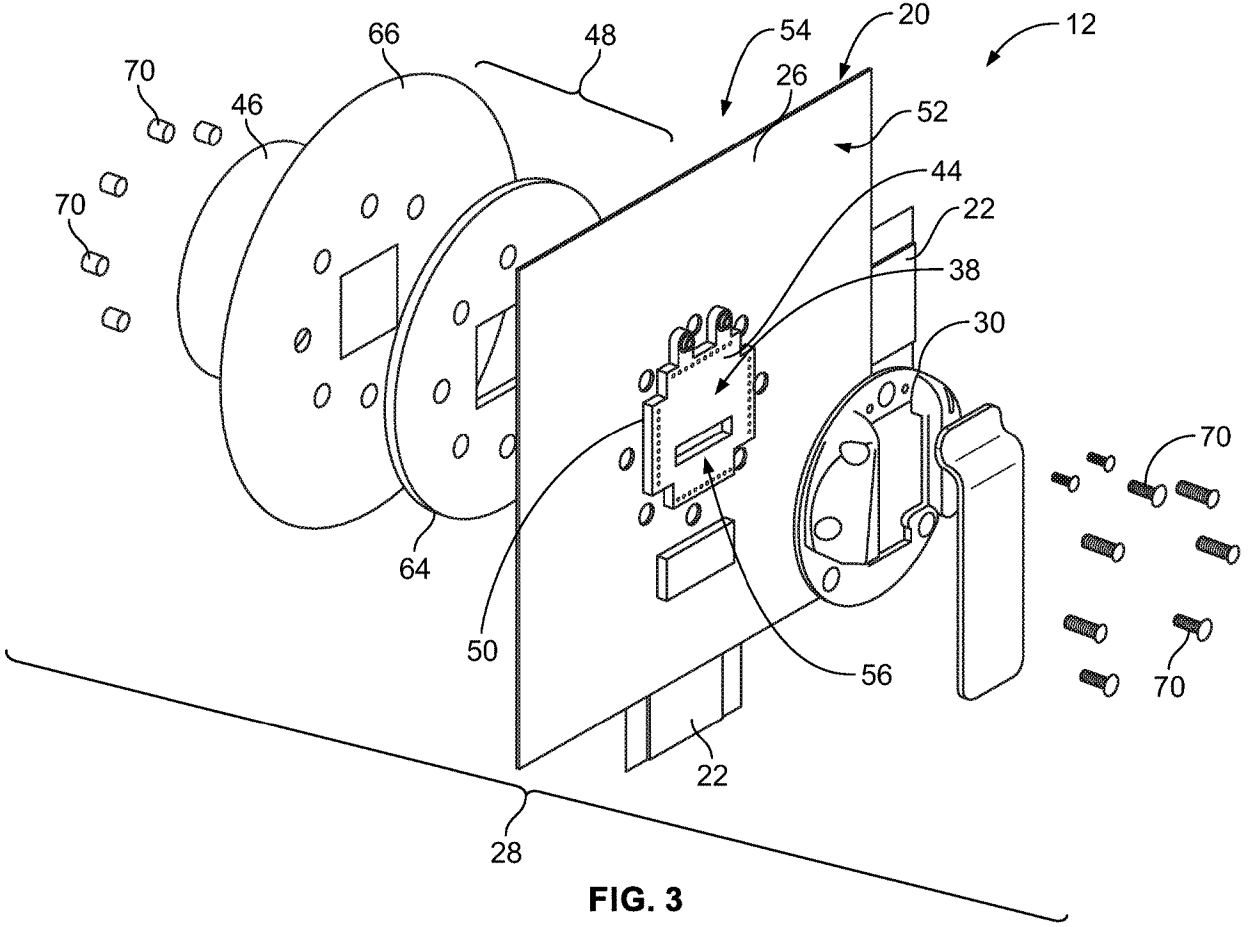
FIG. 3 is an exploded front perspective view of the receptacle connector shown in FIG. 2.
Figure 4:
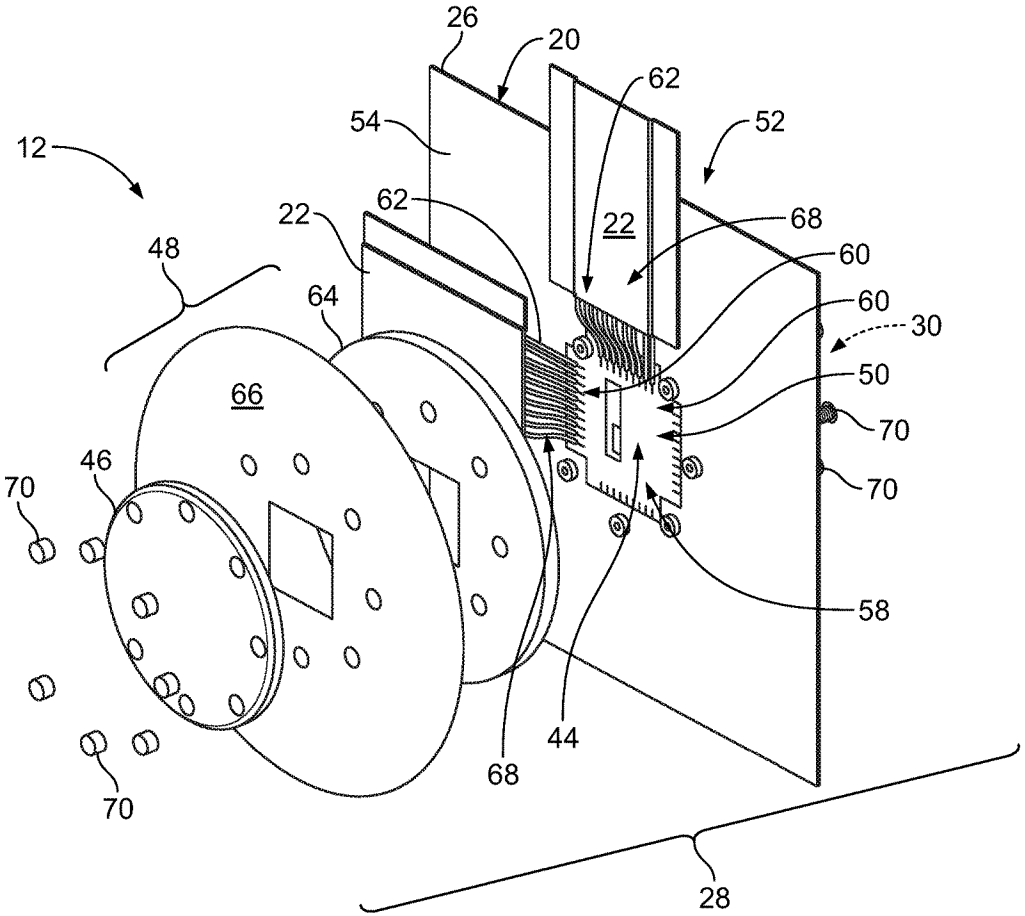
FIG. 4 is an exploded rear perspective view of the receptacle connector shown in FIGS. 2 and 3.

FIGS. 3 and 4 are front and rear, respectively, exploded perspective view of the receptacle connector 12. The receptacle connector 12 includes a printed circuit board 44 and the housing 28, which includes the front mounting plate 30. The housing 28 also includes a back mounting plate 46 and a seal 48. As shown in FIGS. 3 and 4, the printed circuit board 44 is held by the housing 28 within an opening 50 of the sheet 26 of the wearable article 20. FIG. 3 illustrates an exterior side 52 of the sheet 26 of the wearable article 20, while FIG. 4 illustrates an interior side 54 of the sheet 26.

As can be seen in FIG. 3, a first side 56 of the printed circuit board 44 extends on the exterior side 52 of the sheet 26. The contacts 38 extend along the first side 56 of the printed circuit board 44. As shown in FIG. 4, a second side 58 of the printed circuit board 44 extends on the interior side 54 of the sheet 26 of the wearable article 20. Optionally, the printed circuit board 44 includes one or more ground planes (not shown) for providing electromagnetic interference (EMI) protection. For example, in some embodiments, the printed circuit board 44 includes a ground plane on the first side 56 and a ground plane on the second side 58. The printed circuit board 44 optionally includes a circuit element (not shown; such as, but not limited to, a resistor and/or the like) that is configured to provide an indication that indicates whether the connectors 12 and 14 are fully mated together in the mated state shown in FIG. 1.

The printed circuit board 44 includes mounting contacts 60 that extend along the second side 58 of the printed circuit board 44. As shown in FIG. 4, in the illustrated embodiment, the mounting contacts 60 terminate conductors 62 of the flat cables 22 of the wearable article 20. Alternatively, the mounting contacts 60 terminate conductors (not shown) of an e-textile (not shown) of the wearable article 20. Optionally, the mounting contacts 60 include insulation displacement contacts (IDCs; such as, but not limited to, IDCs that are mounted to the printed circuit board 44 via press-fit eye-of-the needle segments) that are configured to terminate the conductors of an e-textile of the wearable article 20. In the illustrated embodiment, the mounting contacts 60 are configured to be ultrasonically welded to the conductors 62 of the flat cables 22. Alternatively, the mounting contacts 60 may be terminated to the conductors 62 in a different manner, such as by soldering, crimping, and/or by other means. Optionally, the mounting contacts 60 may be compression crimped to the conductors 62. Each of the mounting contacts 60 may be a signal contact, a ground contact, or a power contact.

As described above and shown in FIGS. 3 and 4, the housing 28 of the receptacle connector 12 is mounted to the sheet 26 of the wearable article 20 such that the printed circuit board 44 is held within the opening 50 of the wearable article 20. Specifically, the front mounting plate 30 and the back mounting plate 46 connect together with the printed circuit board 44 and the sheet 26 sandwiched between the mounting plates 30 and 46. The seal 48 is sandwiched between the back mounting plate 46 and the sheet 26 of the wearable article 20.

In the illustrated embodiment, the seal 48 includes a sealing member 64 and a seal cover 66. The sealing member 64 is held (i.e., sandwiched) between the seal cover 66 and the sheet 26 of the wearable article 20. The sealing member 64 is elastomeric such that the sealing member 64 is configured to at least partially seal, as is best seen in FIG. 4, the interface between the seal cover 66 and the interior side 54 of the sheet 26. The sealing member 64 thus may prevent, reduce, and/or the like contaminants (such as, but not limited to, dirt, mud, grease, sand, other debris, water, oil, other fluids and/or moisture, and/or the like) from contaminating the mounting interface at which the mounting contacts 60 terminate the conductors 62 of the flat cables 22. For example, the seal 48 may prevent, reduce, and/or the like electrical shorts at the mounting contacts 60. The seal cover 66 may be more rigid as compared to the sealing member 64 to facilitate compressing the sealing member 64 and thereby maintaining a seal between the seal cover 66 and the interior side 54 of the sheet 26 of the wearable article 20.

Figure 5:
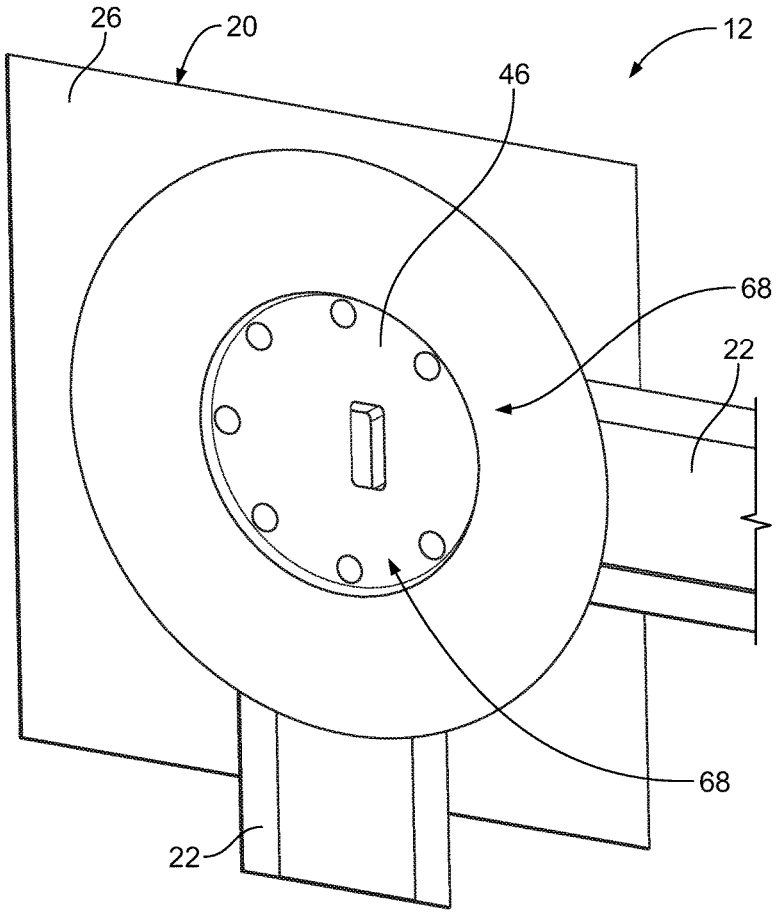
FIG. 5 is a rear perspective view of the receptacle connector shown in FIGS. 2-4.

FIG. 5 is a rear perspective view of the receptacle connector 12. Referring now to FIGS. 4 and 5, the front mounting plate 30 (not visible in FIG. 5) and the back mounting plate 46 are connected together such that at least a portion of an end 68 of the flat cable 22 is sandwiched between the mounting plates 30 and 46. In other words, the end 68 of the flat cable 22 is captured (i.e., contained) between the mounting plates 30 and 46, as is apparent from FIGS. 4 and 5. The housing 28 of the receptacle connector 12 thus provides strain relief to the flat cable 22.

Referring again to FIGS. 3 and 4, the housing 28 of the receptacle connector 12 may be mounted to the wearable article 20 (i.e., the mounting plates 30 and 46 may be connected together) using any type of connection, such as, but not limited to, by being sewn (i.e., stitched) to the sheet 26 of the wearable article 20, by being adhered (i.e., glued) to the sheet 26 using an adhesive, by being riveted to the sheet 26 using one or more rivets, by being bolted to the sheet 26 using one or more threaded fasteners, and/or the like. In the illustrated embodiment, the front mounting plate 30 and the back mounting plate 46 are bolted together using threaded fasteners 70 to connect the mounting plates 30 and 46 together and thereby mount the housing 28 to the sheet 26 of the wearable article 20.

In the illustrated embodiment, the housing 28 of the receptacle connector 12 includes an approximately circular shape, but the housing 28 additionally or alternatively may include any other shape. The circular shape of the housing 28 may prevent, reduce, and/or the like pressure points on the wearer of the wearable article 20 and thereby increase the comfort of the combination of the wearable article 20 and a connector system. The circular shape of the housing 28 may facilitate providing the connector system 10 with a relatively low profile, which may prevent, reduce, and/or the like snagging of the connector system 10 (e.g., which may prevent, reduce, and/or the like the connector system 10 from being damaged).

Optionally, the housing 28 can be mounted to the sheet 26 of the wearable article 20 in any rotational orientation to enable the plug connector 14 (shown in FIGS. 1 and 7-10) to be mated with the receptacle connector 12 from any predetermined direction. Moreover, the contacts 38 on the first side 56 of the printed circuit board 44 may have any arrangement to enable the plug connector 14 to mate with the receptacle connector 12 from any predetermined direction. In other words, the arrangement of the contacts 38 on the first side 56 of the printed circuit board 44 may be selected to enable the plug connector 14 to mate from one of a variety of different directions.

Figure 6:
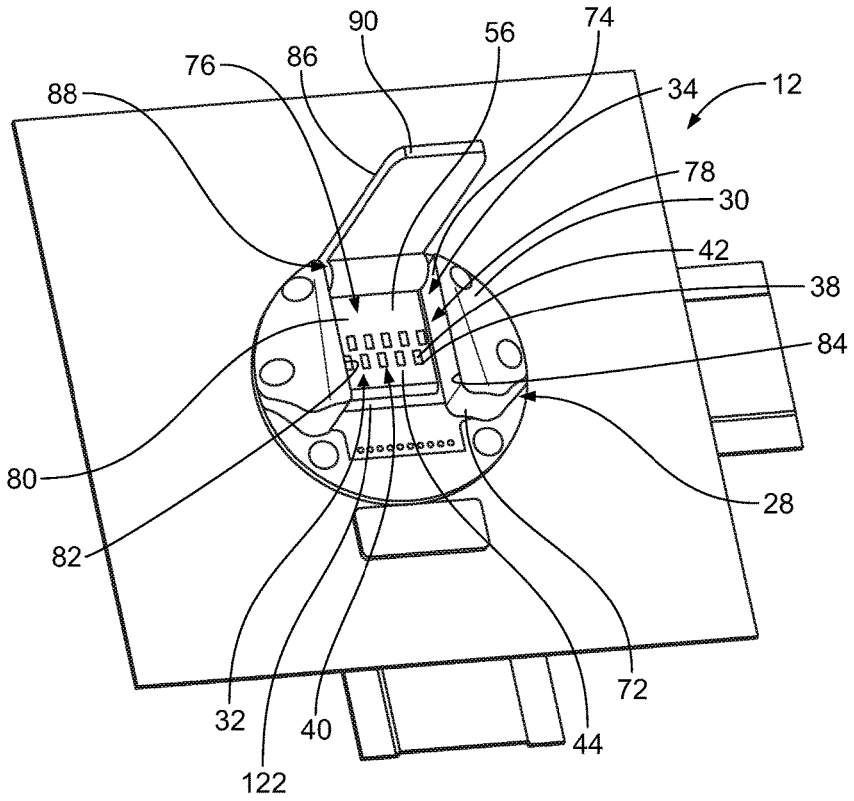
FIG. 6 is an enlarged front perspective view of the receptacle connector shown in FIGS. 2-5.

FIG. 6 is an enlarged front perspective view of the receptacle connector 12. As briefly described above, the front mounting plate 30 includes a channel 32 that defines the receptacle 34 of the receptacle connector 12. The channel 32 extends a length along the housing 28 from a first end 72 to a second end 74. As can be seen in FIG. 6, the first end 72 of the channel 32 is open. The receptacle 34 of the receptacle connector 12 that is defined by the channel 32 is configured to receive the plug 36 (shown in FIGS. 1 and 7-10) of the plug connector 14 (shown in FIGS. 1 and 7-10) therein through the first end 72 of the channel 32.

The channel 32 has a bottom 76 and a top 78 that extend along the length of the channel 32. The bottom 76 of the channel 32 includes a bottom wall 80 that is defined by the first side 56 of the printed circuit board 44, as can be seen in FIG. 6. The mating interface 40 of the receptacle connector 12, including the mating surfaces 42 of the contacts 38, thus extends along the bottom 76 of the channel 32.

The channel 32 includes opposing side walls 82 and 84 that extend from the bottom 76 to the top 78 of the channel 32. Optionally, the side walls 82 and 84 are angled acutely relative to the bottom 76. Specifically, the side 82 and 84 may be angled acutely relative to the bottom wall 80 of the channel 32, as can be seen in FIG. 6. The acutely angled side walls 82 and 84 facilitate holding the plug connector 14 toward the bottom 76 of the channel 32 (i.e., toward the first side 56 of the printed circuit board 44 in physical contact with the contacts 38) to facilitate maintaining a sufficient electrical and/or fiber optic connection between the contacts 38 of the receptacle connector 12 and the corresponding contacts 96 (shown in FIGS. 7-10) of the plug connector 14. The acutely angled side walls 82 and 84 may provide a lead-in feature for insertion of the plug connector 14 into the receptacle 34 of the receptacle connector 12 through the first end 72 of the channel 32. The lead-in feature of the side walls 82 and 84 may ease mating of the connectors 12 and 14 in the low light (e.g., the dark, night, dusk, and/or the like) and/or other low-visibility conditions (e.g., smoke and/or the like). As described above, the housing 28 of the receptacle connector 12 can be mounted to the sheet 26 of the wearable article 20 in any rotational orientation to enable the plug 36 of the plug connector 14 to be received into the first end 72 of the channel 32 from any predetermined direction.

As can be seen in FIG. 6, the top 78 of the channel 32 is open over the mating interface 40 of the receptacle connector 12 such that the mating interface 40, and thus the mating surfaces 42 of the contacts 38, are exposed through the top 78 of the channel 32. The top 78 of the channel is also open through the first end 72 of the channel 32 such that a continuous pathway is defined from the mating interface 40 through the first end 72 of the channel 32.

The channel 32 thus enables the receptacle 34 of the receptacle connector to be cleaned (e.g., wiped). Specifically, the continuous pathway of the open top 78 and the open first end 72 of the channel 32 that is defined from the mating interface 40 through the first end 72 provides a cleanable receptacle 34. Accordingly, the receptacle can be cleaned of contaminants (such as, but not limited to, dirt, mud, grease, sand, other debris, water, oil, other fluids and/or moisture, and/or the like) that: may prevent the plug 36 of the plug connector 14 from being received within the receptacle 34 of the receptacle connector 12; may prevent the contacts 38 of the receptacle connector 12 from establishing a sufficient electrical and/or fiber optic connection with the contacts 96 of the plug connector 14; may damage the receptacle connector 12 (e.g., the contacts 38) and/or the plug connector 14 (e.g., the contacts 96); and/or the like. For example, a user may use a finger, a thumb, a tool, a cloth, and/or the like to wipe across the mating interface 40, through the channel 32, and out the first end 72 to clear contaminants from the receptacle 34. The channel 32 may thus enable the mating surfaces 42 of the contacts 38 to be more reliable and/or be more easily cleaned than the contacts of at least some known connectors. For example, the channel 32 may enable the mating surfaces 42 of the contacts 38 to be cleaned without damaging the contacts 32. Moreover, the open top 78 of the channel 32 may enable the receptacle 34 to trap less contaminants than the receptacles of at least some known connectors.

As shown in FIG. 6, in the illustrated embodiment, the mating interface 40 of the receptacle connector 12 is approximately flat. For example, the mating surface 42 of each of the contacts 38 is approximately flat in the illustrated embodiment. Moreover, and for example, the mating surfaces 42 of the contacts 38 are extend approximately within the same plane in the illustrated embodiment, as shown in FIG. 6. The approximately flat shapes of the mating surfaces 42 and the alignment within the common plane provide the mating interface 40 of the receptacle connector 12 as approximately flat. The approximately flat mating interface 40 may provide a wipeable and/or cleanable surface for cleaning the mating surfaces 42 of the contacts 38. For example, a user may use a finger, a thumb, a tool, a cloth, and/or the like to wipe across the mating interface 40 to clear contaminants from the contacts 38. The approximately flat mating interface 40 may thus enable the mating surfaces 42 of the contacts 38 to be more reliable and/or be more easily cleaned than the contacts of at least some known connectors. For example, the approximately flat mating interface 40 may enable the mating surfaces 42 of the contacts 38 to be cleaned without damaging the contacts 38. Moreover, the approximately flat mating interface 40 may trap less contaminants than the mating interfaces of at least some known connectors.

In the illustrated embodiment, the second end 74 of the channel 32 is open and the top 78 of the channel 32 is open through the second end 74. Accordingly, a continuous pathway is defined from the mating interface 40 through the second end 74 of the channel 32. In some other embodiments, the second end 74 of the channel 32 is closed.

Optionally, the receptacle connector 12 includes a flap 86. In the illustrated embodiment, the flap 86 is mounted to the front mounting plate 30 at the second end 74 of the channel 32. The flap 86 is mounted to the front mounting plate 30 at a hinge 88 such that the flap 86 is hinged at the second end 74 of the channel 32. The flap 86 thus at least partially closes the second end 74 of the channel 32 in the illustrated embodiment. The flap 86 is configured to cover the mating interface 40 of the receptacle connector 12 when the connectors 12 and 14 are not mated together (i.e., when the plug 36 of the plug connector 14 is not received within the receptacle 34 of the receptacle connector 12). The flap 86 thus may prevent, reduce, and/or the like contaminants (such as, but not limited to, dirt, mud, grease, sand, other debris, water, oil, other fluids and/or moisture, and/or the like) from contaminating the mating interface 40 of the receptacle connector 12.

The flap 86 is also configured to cover the top 78 of the channel 32 when the plug connector 14 is received within the receptacle 34 of the receptacle connector (i.e., when the connectors 12 and 14 are mated together. Optionally, the flap 86 includes a latch mechanism 90 that is configured to cooperate with a latch mechanism 124 (shown in FIG. 7) of the plug connector 14 to latch (i.e., hold) the connectors 12 and 14 together in a mated state wherein the connectors 12 and 14 are mated together as shown in FIG. 1. In the illustrated embodiment, the latch mechanism 90 includes hook and loop fasteners (e.g., Velcro®), but the latch mechanism 90 additionally or alternatively may include any other structure that enables the latch mechanism 90 to cooperate with the latch mechanism 124 of the plug connector 14 to latch the connectors 12 and 14 together in the mated state. The flap 86 may facilitate providing the connector system 10 with a relatively low profile, which may facilitate use of the connector system 10 with wearable articles and/or may prevent, reduce, and/or the like snagging of the connector system 10. Optionally, the flap 86 is relatively flexible. The flap 86 is optionally constructed from an electrically conductive material to provide EMI protection.

Figure 7:
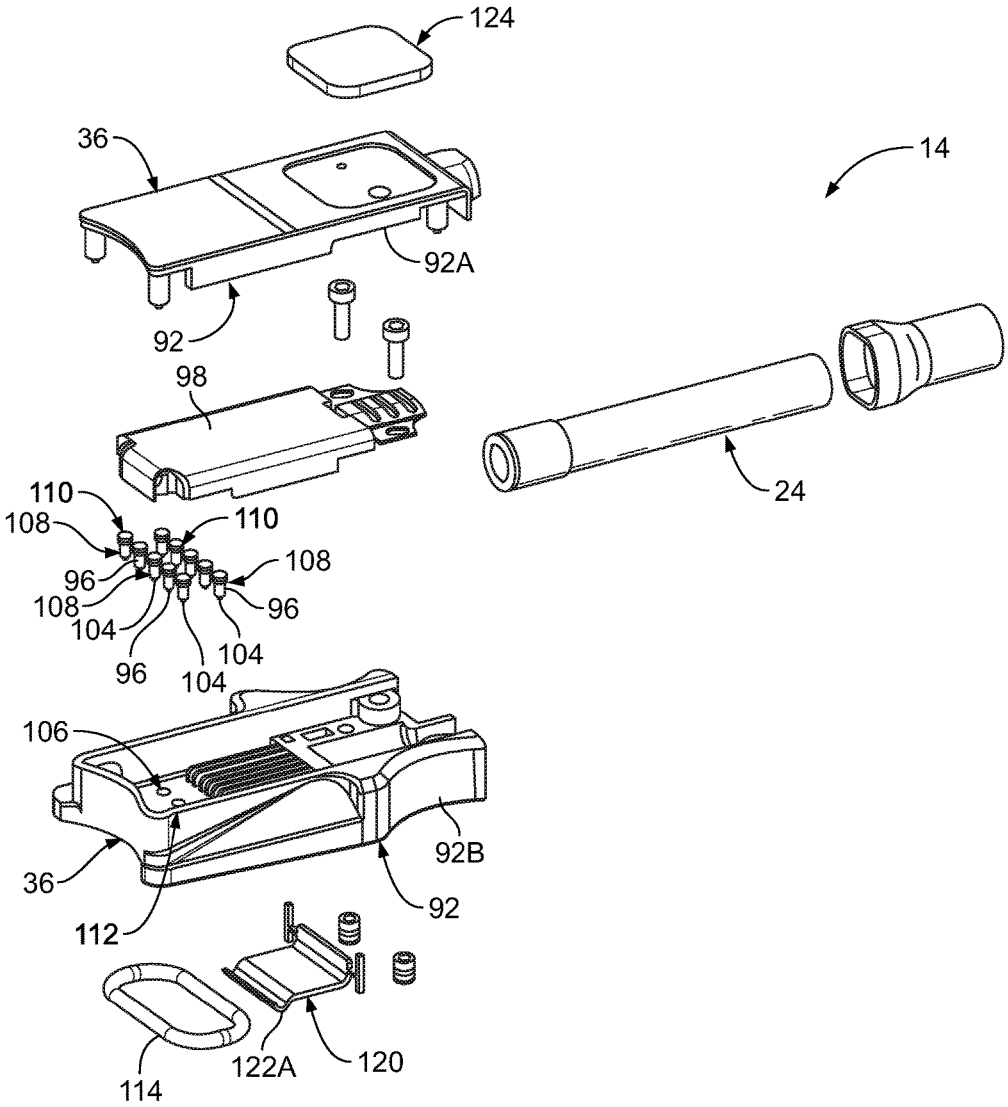
FIG. 7 is an exploded upper perspective view of an embodiment of a plug connector of the connector system shown in FIG. 1.

FIG. 7 an exploded perspective view of an embodiment of the plug connector 14. The plug connector 14 includes a housing 92 and contacts 96 held by the housing 92. The contacts 96 are connected to corresponding conductors (not shown) of the cable 24. The plug connector 14 optionally includes a metal shield 98 that is held by the housing 92. The metal shield 98 provides EMI shielding and may provide impedance control. The contacts 96 may be referred to herein as "mating contacts".

The contacts 96 that are arranged in a mating interface 102 (shown in FIG. 9) at which the plug connector 14 is configured to mate with the receptacle connector 12 (shown in FIGS. 1-6 and 10) to electrically and/or fiber-optically connect the connectors 12 and 14 together. Specifically, the mating interface 102 is configured such that mating surfaces 104 of the contacts 96 mate in physical contact with the mating surfaces 42 (shown in FIGS. 2 and 6) of the corresponding contacts 38 (shown in FIGS. 2, 3, and 6) of the receptacle connector 12 when the connectors 12 and 14 are mated together. Each of the contacts 96 may be a signal contact, a ground contact, or a power contact. In the illustrated embodiment, the contacts 96 are pogo compression contacts, but any other type of contact may be used. For example, in some other embodiments (e.g., the contacts 396 of the plug connector 314 shown in FIGS. 12-14), the contacts 96 are stamped and formed deflectable spring contacts. In some other embodiments, and for example, the plug connector 14 includes a printed circuit board (not shown) that is connected to the conductors of the cable 24 and includes the contacts 96 (e.g., the contacts 96 are compression contacts of the printed circuit board).

Figure 15:
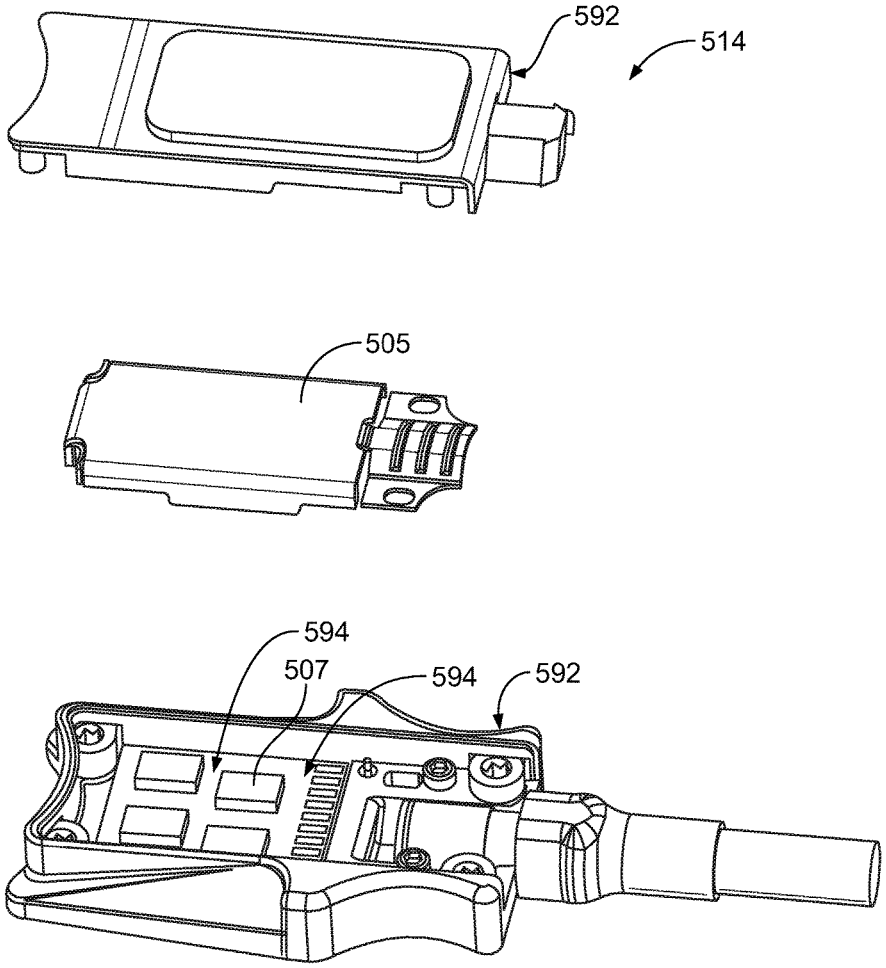
FIG. 15 is an exploded upper perspective view of another embodiment of a plug connector.

For example, FIG. 15 an exploded perspective view of another embodiment of a plug connector 514. The plug connector 514 includes a housing 592 and a printed circuit board 594 held by the housing 592. The printed circuit board 594 includes mating contacts (not shown), which are electrically connected to corresponding conductors (not shown) of a cable 524. The plug connector 514 optionally includes a metal shield 505 that is held by the housing 592. The metal shield 505 provides EMI shielding and may provide impedance control. Each of the mating contacts of the printed circuit board 594 may be a signal contact, a ground contact, or a power contact. Moreover, each of the mating contacts of the printed circuit board 594 may be any type of contact, such as, but not limited to, a surface pad of the printed circuit board 594, a compression contact of the printed circuit board 594, and/or the like.

The printed circuit board 594 may include one or more additional components in addition to the mating contacts, such as, but not limited to, a ground plane (not shown), any type of circuit element, and/or the like. For example, in the illustrated embodiment the printed circuit board 594 includes a circuit element 507 (such as, but not limited to, a resistor and/or the like) that is configured to provide an indication that indicates whether the connector 514 is fully mated with a complementary connector (e.g., the receptacle connector 12 shown in FIGS. 6 and 10).

Referring again to FIG. 7, the illustrated embodiment of the housing 92 of the plug connector 14 includes two complementary shells 92A and 92B that connect together to define the housing 92. Other arrangements, structures, and/or the like may be used in other embodiments. The shell 92B of the housing 92 includes contact cavities 106 into which mating ends 108 (which include the mating surfaces 104) of the contacts 96 extend, as is shown in FIGS. 9 and 10.

The contacts 96 are configured to be received within corresponding contact cavities 106 through rear ends 112 of the contact cavities 106. As can be seen in FIG. 7, ends 110 of the contacts 96 are enlarged and have complementary shapes with the corresponding contact cavities 106. The complementary shapes of the contact ends 110 act (i.e., function) as plugs that at least partially seal the rear ends 112 of the contact cavities 106. The seals provided by the contact ends 110 may prevent, reduce, and/or the like water, moisture, and/or other fluids from entering the housing 96 through front ends 116 (shown in FIG. 9) of the contact cavities 106. The seals provided by the contact ends 110 thereby may prevent, reduce, and/or the like electrical shorts between contacts 96. The seals provided by the contact ends 110 may enable the plug connector 14 to be water tight.

Figure 9:
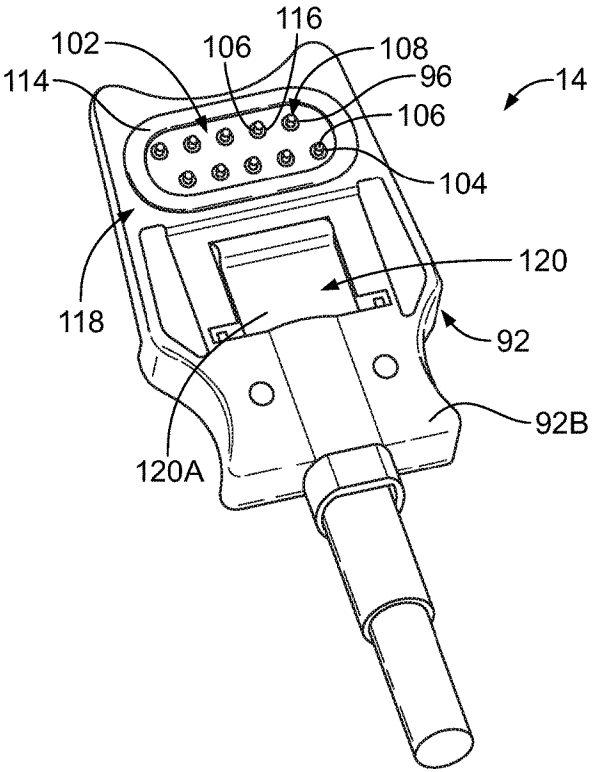
FIG. 9 is a lower perspective view of the plug connector shown in FIGS. 7 and 8.
Figure 10:
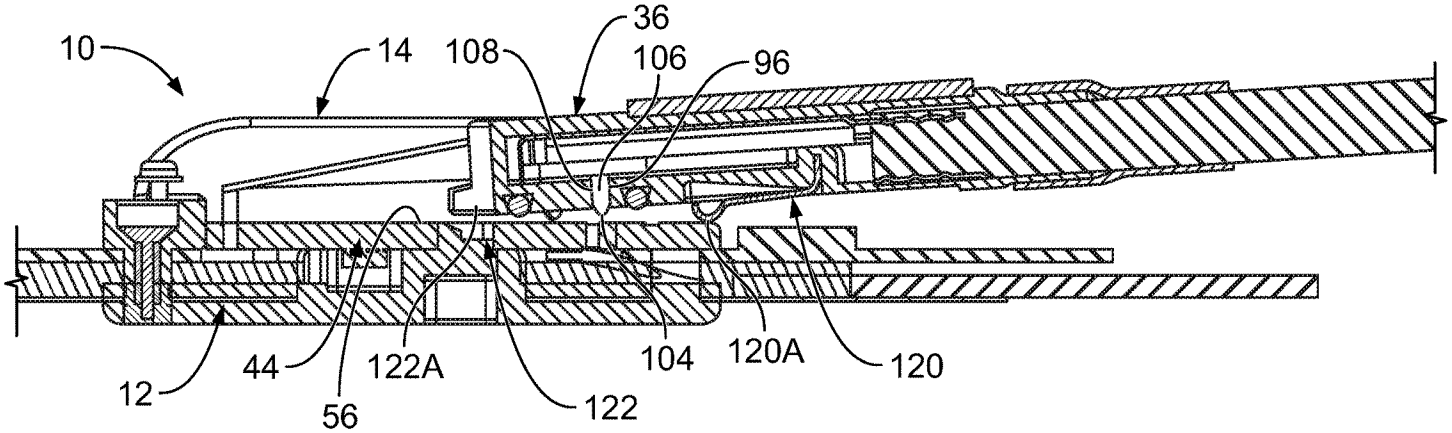
FIG. 10 is a cross-sectional view of the connector system shown in FIG. 1.

Referring now to FIGS. 7 and 9, the plug connector 14 optionally includes a seal 114 that extends around the mating interface 102. The seal 114 is configured to sealingly engage the printed circuit board 44 (shown in FIGS. 2-4, 6, and 10) of the receptacle connector 12 (shown in FIGS. 1-6 and 10) to seal the mated interface between the connectors 12 and 14. Optionally, the seal 114 is elastomeric. The seal provided by the seal 114 may provide the mated interface between the connectors 12 and 14 as water tight.

Referring now to FIG. 9, the mating interface 102 of the plug connector 14 may provide a wipeable and/or cleanable surface for cleaning the mating surfaces 104 of the contacts 96. For example, a user may use a finger, a thumb, a tool, a cloth, and/or the like to wipe across the mating interface 102 to clear contaminants from the contacts 96. The mating interface 102 may thus enable the mating surfaces 104 of the contacts 96 to be more reliable and/or be more easily cleaned than the contacts of at least some known connectors. For example, the mating interface 102 may enable the mating surfaces 104 of the contacts 96 to be cleaned without damaging the contacts 96. Moreover, the mating interface 102 may trap less contaminants than the mating interfaces of at least some known connectors.

The mating ends 108 of the contacts 96 extend through front ends 116 of the corresponding contact cavities 106, as is shown in FIG. 9. The mating surfaces 104 of the mating ends 108 extend a distance outward from a mating side 118 of the shell 92B that is less than the distance the seal 114 extends outward from the mating side 118, which may increase the durability of the contacts 96 by preventing, reducing, and/or the like the mating surfaces 104 from engaging in physical contact with the first side 56 (shown in FIGS. 3, 6, and 10) of the printed circuit board 44 (shown in FIGS. 2-4, 6, and 10) of the receptacle connector 12 (shown in FIGS. 1-6 and 10) during mating of the connectors 12 and 14.

Referring now to FIGS. 7 and 9, the plug connector 14 includes a latch mechanism 120 that is configured to cooperate with a latch mechanism 122 (shown in FIGS. 6 and 10) of the receptacle connector 12 to latch (i.e., hold) the connectors 12 and 14 together in the mated state wherein the connectors 12 and 14 are mated together as shown in FIG. 1. In the illustrated embodiment, the latch mechanism 120 includes a deflectable spring 120A that is configured to be received within a latch opening 122A (shown in FIGS. 6 and 10) of the latch mechanism 122 of the receptacle connector 12. The spring 120A has a curved shape that is configured to draw (i.e., pull) the plug connector 14 into the receptacle 34 (shown in FIGS. 2, 6, and 10) of the receptacle connector 12 as the spring 120A is received into the latch opening 122A. The spring 120A thus facilitates ensuring that the connectors 12 and 14 fully mate together. The latch mechanisms 120 and 122 additionally or alternatively may include any other structure that enables the latch mechanisms 120 and 122 to cooperate 14 to latch the connectors 12 and 14 together in the mated state.

FIG. 10 is a cross-sectional view of the connector system 10 illustrating the connectors 12 and 14 being mated together. The latch mechanism 120 may protect the contacts 96 during mating of the connectors 12 and 14. For example, the spring 120A of the latch mechanism 120 may prevent, reduce, and/or the like the mating surfaces 104 of the contacts 96 from engaging in physical contact with the first side 56 of the printed circuit board 44 of the receptacle connector 12 during mating of the connectors 12 and 14, as can be seen in FIG. 10. Specifically, FIG. 10 illustrates that physical contact between the latch mechanism 120 and the first side 56 of the printed circuit board 44 causes the plug connector 14 to be angled with respect to the first side 56 of the printed circuit board 44, which prevents the contacts 96 from engaging in physical contact with the first side 56 of the printed circuit board 44 during mating of the connectors 12 and 14. The latch mechanism 120 thus may increase the durability of the contacts 96.

Figure 8:
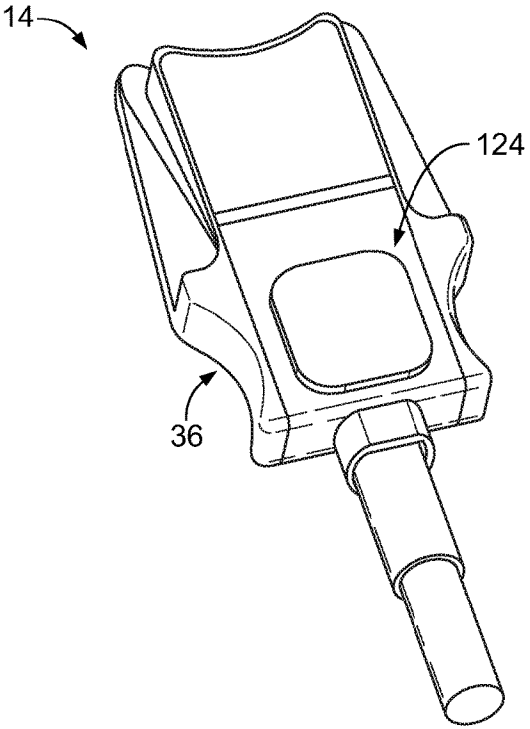
FIG. 8 is an upper perspective view of the plug connector shown in FIG. 7.

Referring now to FIGS. 7 and 8, the plug connector 14 includes the latch mechanism 124 that is configured to cooperate with the latch mechanism 90 (shown in FIGS. 1 and 6) of the flap 86 (shown in FIGS. 1 and 6) of the receptacle connector 12 (shown in FIGS. 1-6 and 10) to latch (i.e., hold) the connectors 12 and 14 together in the mated state wherein the connectors 12 and 14 are mated together as shown in FIG. 1. In the illustrated embodiment, the latch mechanism 124 includes hook and loop fasteners (e.g., Velcro®), but the latch mechanism 124 additionally or alternatively may include any other structure that enables the latch mechanisms 90 and 124 to cooperate to latch the connectors 12 and 14 together in the mated state. FIG. 1 illustrates the flap 86 covering the mated connectors 12 and 14 with the latch mechanisms 90 and 124 engaged to latch the connectors 12 and 14 in the mated state.

Figure 11:
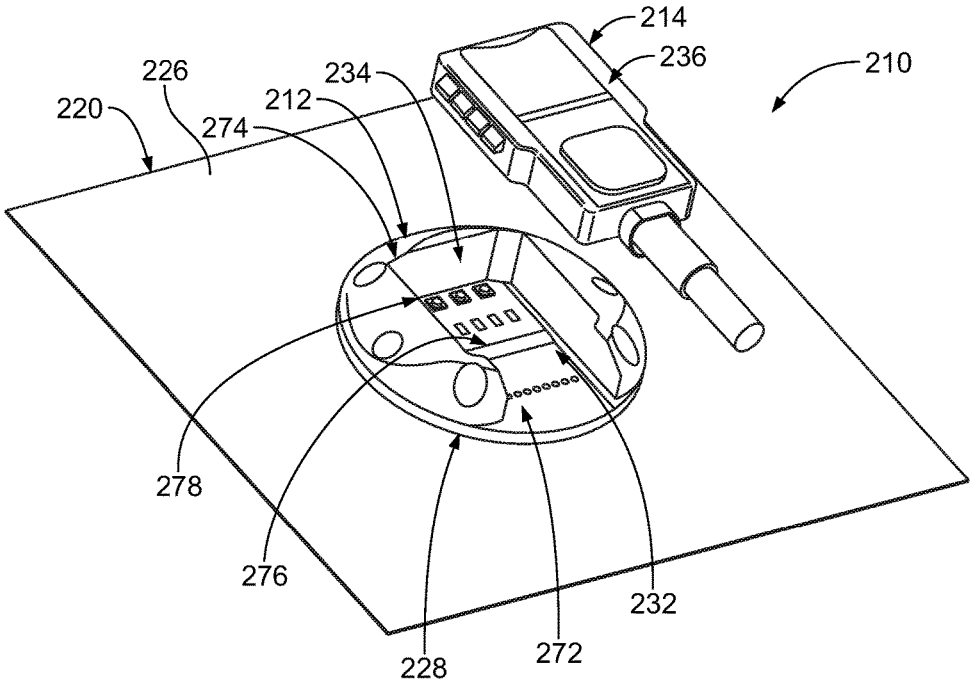
FIG. 11 is a partially exploded perspective view of another embodiment of a connector system.

FIG. 11 is a partially exploded perspective view of another embodiment of a connector system 210. The connector system 210 includes a receptacle connector 212 and a plug connector 214 that mate together to form an electrical and/or fiber optic connection therebetween. The receptacle connector 212 is mounted to a sheet of material 226 of a wearable article 220. The receptacle connector 212 includes a housing 228 having a channel 232 that defines a receptacle 234 of the receptacle connector 212. The channel 232 enables the receptacle 234 to be cleaned, for example as described above with respect to the channel 32 (shown in FIGS. 2 and 6) of the receptacle connector 12 (shown in FIGS. 1-6). The receptacle 234 of the receptacle connector 212 is configured to receive a plug 236 of the plug connector 214 therein for mating the connectors 212 and 214 together. In other words, the plug 236 of the plug connector 214 is inserted (i.e., plugged) into the receptacle 234 of the receptacle connector 212 to mate the plug connector 214 with the receptacle connector 212.

The channel 232 extends a length along the housing 228 from a first end 272 to a second end 274. The channel 232 has a bottom 276 and a top 278 that extend along the length of the channel 232. As can be seen in FIG. 11, the first end 272 and the top 278 of the channel 232 are each open. In the embodiment of FIG. 11, the receptacle 234 of the receptacle connector 212 is configured to receive the plug 236 of the plug connector 214 therein through the open top 276 of the channel 232 to mate the connectors 212 and 214 together.

Figure 12:
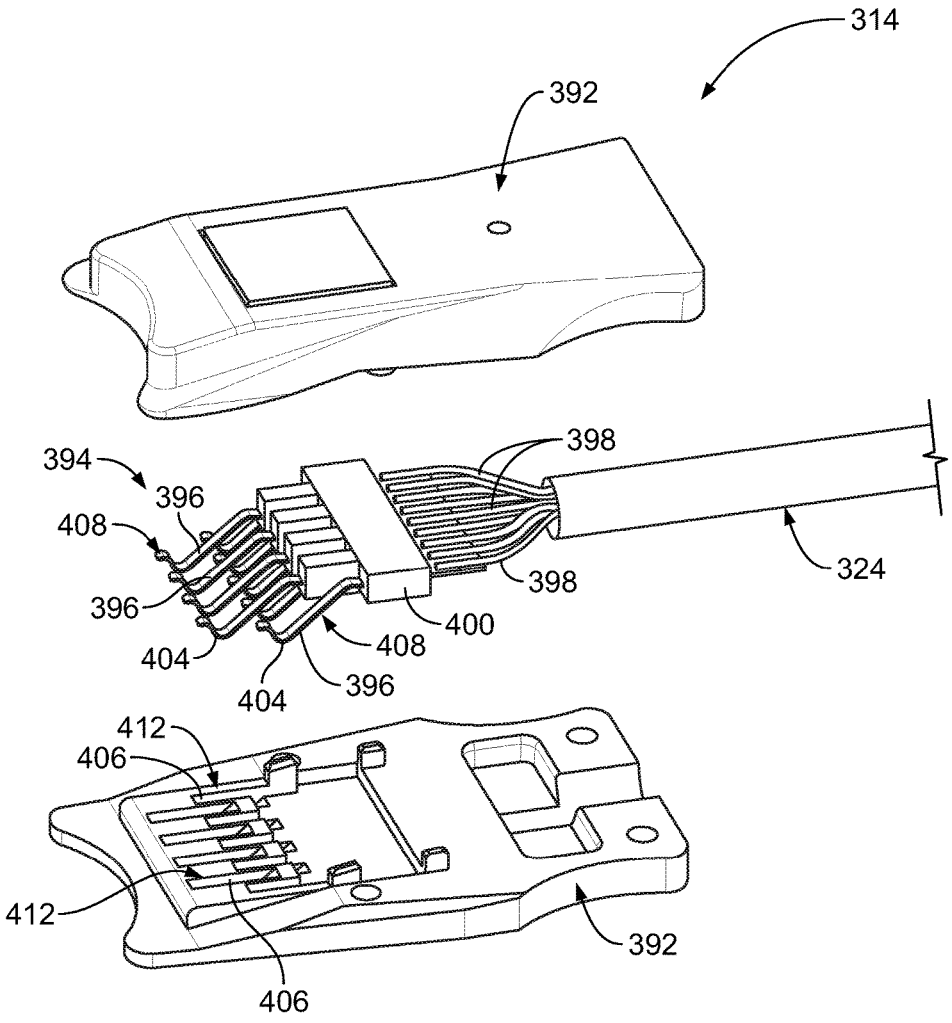
FIG. 12 an exploded upper perspective view of another embodiment of a plug connector.
Figure 13:
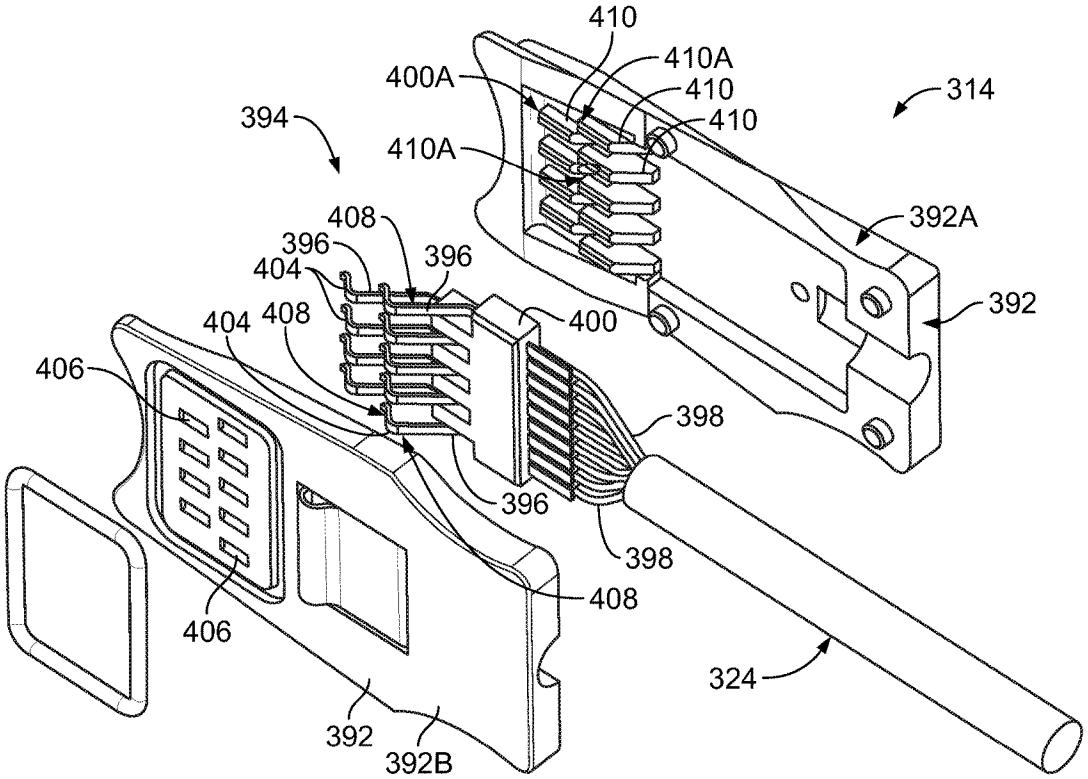
FIG. 13 is an exploded lower perspective view of the plug connector shown in FIG. 12.

FIG. 12 an exploded perspective view of another embodiment of a plug connector 314. FIG. 13 is an exploded lower perspective view of the plug connector 314. Referring to FIGS. 12 and 13, the plug connector 314 includes a housing 392 and a contact assembly 394 held by the housing 392. The contact assembly 394 includes contacts 396, which are connected to corresponding conductors 398 of a cable 324. The contact assembly 394 has an insulator 400 that holds the contacts 396. The plug connector 314 optionally includes a metal shield (not shown) that is held by the housing 392. The insulator 400 electrically isolates the contacts 96 from the metal shield and may provide impedance control.

Figure 14:
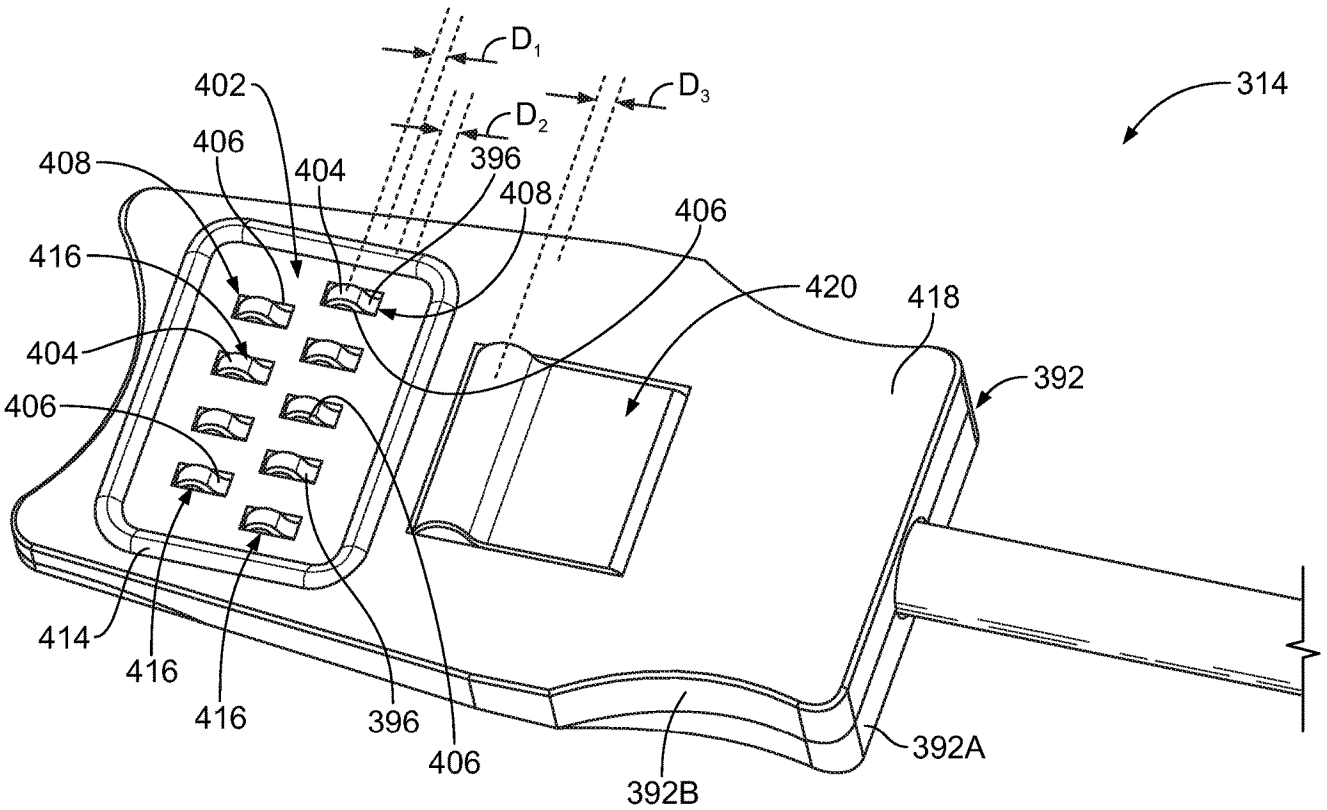
FIG. 14 is a lower perspective view of the plug connector shown in FIGS. 12 and 13.

The contacts 396 that are arranged in a mating interface 402 (shown in FIG. 14). Each of the contacts 396 may be a signal contact, a ground contact, or a power contact. In the illustrated embodiment, the contacts 396 are stamped and formed deflectable spring contacts. The contacts 396 may be referred to herein as "mating contacts".

Referring now to FIG. 13, the illustrated embodiment of the housing 392 includes two complementary shells 392A and 392B that connect together to define the housing 392. Other arrangements, structures, and/or the like may be used in other embodiments. The shell 392B of the housing 392 includes contact cavities 406 into which mating ends 408 (which include mating surfaces 404) of the contacts 396 extend, as is shown in FIG. 14. The shell 392A of the housing 392 includes ribs 410. The mating ends 408 of the contacts 396 extend over corresponding ribs 410. The ribs 410 have contoured segments 410A that are configured to engage in physical contact with the mating ends 408 of the contacts 396 as the contacts 396 are deflected during mating. The contoured segments 410A are shaped complementary with the mating ends 408 of the contacts 396 such that the mating ends 408 engage the corresponding ribs 410 with a relatively smooth fit (i.e., the contoured segments 410A of the ribs 410 nest within the corresponding mating ends 408 with a fit that does not distort the shape of the corresponding mating ends 408). The complementary shape of the contoured segments 410A of the ribs 410 with the mating ends 408 of the contacts 396 may facilitate increasing the durability of the contacts 396.

The ribs 410 may protect the mating ends 408 of the contacts 396 from over-deflection. For example, the ribs 410 may prevent the mating ends 408 from being deflected to or past a position where the mating ends 408 are damaged from being deflected past the working range of the mating ends 408.

Referring now to FIGS. 12 and 13, the ribs 410 (not visible in FIG. 12) are configured to be received within corresponding contact cavities 406 through rear ends 412 (not visible in FIG. 13) of the contact cavities 406. As can be seen from a comparison of FIGS. 12 and 13, the ribs 410 have complementary shapes with the corresponding contact cavities 406. The complementary shapes of the ribs 410 act (i.e., function) as plugs that at least partially seal the rear ends 412 of the contact cavities 406. The seals provided by the ribs 410 may prevent, reduce, and/or the like water, moisture, and/or other fluids from entering the housing 396. The seals provided by the ribs 410 thereby may prevent, reduce, and/or the like electrical shorts between contacts 396. The seals provided by the ribs 410 may enable the plug connector 314 to be water tight.

Referring now to FIG. 14, the mating interface 402 of the plug connector 314 may provide a wipeable and/or cleanable surface for cleaning the mating surfaces 404 of the contacts 396. For example, a user may use a finger, a thumb, a tool, a cloth, and/or the like to wipe across the mating interface 402 to clear contaminants from the contacts 396. The mating interface 402 may thus enable the mating surfaces 404 of the contacts 396 to be more reliable and/or be more easily cleaned than the contacts of at least some known connectors. For example, the mating interface 402 may enable the mating surfaces 404 of the contacts 396 to be cleaned without damaging the contacts 396. Moreover, the mating interface 402 may trap less contaminants than the mating interfaces of at least some known connectors.

The mating ends 408 of the contacts 396 extend through front ends 416 of the corresponding contact cavities 406, as is shown in FIG. 14. The mating surfaces 404 of the mating ends 408 extend a distance $D_1$ outward from a mating side 418 of the shell 392*b*. The distance $D_1$ may be reduced (for example as compared to the distance $D_2$ that a seal 414 and/or the distance $D_3$ that a latch 420 extends outward from the mating side 418), which may increase the durability of the contacts 396 by preventing, reducing, and/or the like the mating surfaces 404 from engaging in physical contact with a non-contact surface (e.g., a printed circuit board, a housing, and/or the like) of the corresponding receptacle connector 12 during mating.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector for a wearable article, the receptacle connector comprising:

a housing having a front mounting plate and a back mounting plate, the front mounting plate including a receptacle configured to receive a complementary plug connector therein, the front mounting plate and the back mounting plate of the housing being configured to be mounted to the wearable article such that a sheet of the wearable article is sandwiched between the front mounting plate and the back mounting plate with the front mounting plate along an exterior side of the sheet of the wearable article and with the back mounting plate along an interior side of the sheet of the wearable article and such that the receptacle is configured to be aligned with an opening in the sheet; and a printed circuit board sandwiched between the front mounting plate and the back mounting plate such that the printed circuit board is held by the housing aligned with the opening in the sheet of the wearable article, the printed circuit board comprising mating contacts exposed on the exterior side of the sheet of the wearable article for mating with the plug connector, the printed circuit board comprising mounting contacts exposed on the interior side of the sheet of the wearable article that are configured to terminate conductors of a flat cable of the wearable article or an e-textile of the wearable article that is on the interior side of the sheet of the wearable article.

2. The receptacle connector of claim 1, wherein the printed circuit board comprises opposite first and second sides, the mating contacts extend along the first side, the mounting contacts extend along the second side, the first side extends on the exterior side of the wearable article, and the second side extends on the interior side of the wearable article.

3. The receptacle connector of claim 1, wherein the wearable article includes the flat cable and the mounting contacts of the printed circuit board are configured to terminate the conductors of the flat cable, the front mounting plate and the back mounting plate connect together with at least a portion of an end of the flat cable being sandwiched between the front and back mounting plates such that the housing provides strain relief to the flat cable.

4. The receptacle connector of claim 1, wherein the wearable article includes the e-textile and the mounting contacts of the printed circuit board comprise insulation displacement contacts (IDCs) that are configured to terminate the conductors of the e-textile.

5. The receptacle connector of claim 1, wherein the printed circuit board comprises a circuit element that is configured to provide an indication that indicates whether the receptacle and plug connectors are fully mated together.

6. The receptacle connector of claim 1, wherein the mating contacts of the printed circuit board comprise surface pads of the printed circuit board.

7. The receptacle connector of claim 1, wherein the housing is configured to be at least one of bolted, riveted, glued, or stitched to the wearable article.

8. A receptacle connector for a wearable article, the receptacle connector comprising:

a housing having a receptacle configured to receive a complementary plug connector therein, the housing being configured to be mounted to the wearable article;

contacts held by the housing, the contacts being arranged in a mating interface along which the receptacle connector mates with the plug connector, the contacts comprising mating surfaces at which the contacts mate in physical contact with corresponding mating contacts of the plug connector; and wherein the receptacle of the housing is defined by a channel that extends a length along the housing from a first end to a second end, at least the first end of the channel being open, the channel having a bottom and a top that extend along the length of the channel, the mating interface of the receptacle connector extending along the bottom of the channel, the top of the channel being open over the mating interface such that the mating surfaces of the contacts are exposed through the top, the top of the channel being open through the first end of the channel such that a continuous pathway is defined from the mating interface through the first end.

9. The receptacle connector of claim 8, wherein the second end of the channel is open and the top of the channel is open through the second end of the channel such that a continuous pathway is defined from the mating interface through the second end.

10. The receptacle connector of claim 8, wherein the housing comprises a front mounting plate and a back mounting plate that connect together with a portion of the wearable article being sandwiched between the front and back mounting plates, the housing further comprising a seal sandwiched between the back mounting plate and the wearable article.

11. The receptacle connector of claim 8, wherein the mating surfaces of the contacts are approximately flat and are arranged within approximately the same plane to provide the mating interface as approximately flat.

12. The receptacle connector of claim 8, further comprising a printed circuit board held by the housing, the contacts comprising surface pads of the printed circuit board.

13. The receptacle connector of claim 8, further comprising a printed circuit board held by the housing, wherein the printed circuit board comprises a circuit element that is configured to provide an indication that indicates whether the receptacle and plug connectors are fully mated together.

14. The receptacle connector of claim 8, further comprising a printed circuit board held by the housing, the printed circuit board comprising mounting contacts that are configured to terminate conductors of an e-textile of the wearable article, wherein the wearable article includes the e-textile and the mounting contacts of the printed circuit board comprise insulation displacement contacts (IDCs) that are configured to terminate the conductors of the e-textile.

15. The receptacle connector of claim 8, wherein the receptacle is configured to receive the plug connector therein through the first end of the channel.

16. The receptacle connector of claim 8, wherein the channel comprises a side wall that extends from the bottom of the channel to the top of the channel, the side wall being angled acutely relative to the bottom for holding the plug connector toward the bottom of the channel.

17. The receptacle connector of claim 8, wherein the housing is configured to be at least one of bolted, riveted, glued, or stitched to the wearable article.

18. The receptacle connector of claim 8, wherein the printed circuit board defines a bottom wall of the bottom of the channel.

19. A wearable article comprising:

a sheet of material configured to be worn by an individual; and a receptacle connector mounted to the sheet of material, the receptacle connector comprising:

a housing having a receptacle configured to receive a complementary plug connector therein; and a printed circuit board held by the housing, the printed circuit board comprising mating contacts for mating with the plug connector, the printed circuit board comprising mounting contacts that terminate conductors of a flat cable of the wearable article or an e-textile of the wearable article, wherein the printed circuit board comprises opposite first and second sides, the mating contacts extend along the first side, the mounting contacts extend along the second side, the first side extends on an exterior side of the sheet, and the second side extends on an interior side of the sheet.

20. The wearable article of claim 19, wherein the housing includes a front mounting plate and a back mounting plate, the front mounting plate including the receptacle, the front mounting plate and the back mounting plate of the housing being configured to be mounted to the wearable article such that the sheet is sandwiched between the front mounting plate and the back mounting plate with the front mounting plate along an exterior side of the sheet and with the back mounting plate along an interior side of the sheet and such that the receptacle is configured to be aligned with an opening in the sheet, the printed circuit board being sandwiched between the front mounting plate and the back mounting plate such that the printed circuit board is held by the housing aligned with the opening in the sheet of the wearable article.

* * * * *